US010161144B2

(12) United States Patent
Dombrowski et al.

(10) Patent No.: US 10,161,144 B2
(45) Date of Patent: Dec. 25, 2018

(54) VARIABLE ANGLE CORNER FLUSHER

(71) Applicant: CanAm Tool Corp., Sturgeon County (CA)

(72) Inventors: Wolfgang Dombrowski, Sturgeon County (CA); Lucien Dnestrianschii, St. Albert (CA); Micah Warkentin, Edmonton (CA)

(73) Assignee: CanAm Tool Corp., Sturgeon County, AB (CA)

( * ) Notice: Subject to any disclaimer, the term of this patent is extended or adjusted under 35 U.S.C. 154(b) by 0 days.

(21) Appl. No.: 15/739,231

(22) PCT Filed: Jun. 15, 2016

(86) PCT No.: PCT/CA2016/050695
§ 371 (c)(1),
(2) Date: Dec. 22, 2017

(87) PCT Pub. No.: WO2016/205928
PCT Pub. Date: Dec. 29, 2016

(65) Prior Publication Data

US 2018/0187427 A1 Jul. 5, 2018

(30) Foreign Application Priority Data

Jun. 23, 2015 (CA) ..... 2894975

(51) Int. Cl.
*E04F 21/165* (2006.01)

(52) U.S. Cl.
CPC ..... *E04F 21/1655* (2013.01)

(58) Field of Classification Search
CPC ..... E04F 21/1655
See application file for complete search history.

(56) References Cited

U.S. PATENT DOCUMENTS 684,576 A 10/1901 Lucas
1,383,688 A 7/1921 Word
(Continued)

FOREIGN PATENT DOCUMENTS

CA 2 515 473 A1 2/2007
FR 2400092 A1 3/1979

OTHER PUBLICATIONS

International Search report filed in corresponding PCT Application No. PCT/CA2016/050695 dated Aug. 16, 2016.
(Continued)

*Primary Examiner* — Randall Chin
(74) *Attorney, Agent, or Firm* — Davis & Bujold PLLC; Michael J. Bujold

(57) ABSTRACT

A variable angle corner flusher tool includes a pair of blades pivotally connected along one edge. An activator assembly is provided to facilitate angular adjustment of the blades. The activator assembly includes an activator screw and a slider bracket that moves axially along the activator screw. A pair of linkage arms are provided, with each linkage arm having a first end attached to the slider bracket and a second end attached to one the pair of blades. The linkage arms results in an axial position of the slider bracket along the activator screw determining the angular positioning of the blades. A ratchet plate is pivotally mounted to the slider bracket. The ratchet plate is selectively pivoted between an engaged position engaged with the activator screw and a disengaged position disengaged from activator screw.

1 Claim, 8 Drawing Sheets

(56) References Cited

U.S. PATENT DOCUMENTS

| | | | | |
|---|---|---|---|---|
| 4,619,013 | A | 10/1986 | Yon | |
| 4,757,572 | A * | 7/1988 | Yon | B05C 17/10 15/235.7 |
| 5,442,832 | A | 8/1995 | Tonsager | |
| 5,792,489 | A * | 8/1998 | Liberman | E04F 21/1655 15/235.7 |
| 7,246,402 | B2 | 7/2007 | Washburn | |
| 2016/0356049 | A1 * | 12/2016 | Potter | E04F 21/1655 |

OTHER PUBLICATIONS

Written Opinion filed in corresponding PCT Application No. PCT/CA2016/050695 dated Aug. 16, 2016.

* cited by examiner

VARIABLE ANGLE CORNER FLUSHER

FIELD

There is described a tool used to spread drywall compound, known as a variable angle corner flusher.

BACKGROUND

A variable angle corner flusher is a tool that is used to spread drywall compound in the joint between drywall sheets. The variable angle allows the same flusher to be used on corners with differing angles between sheets. An example of a variable angle corner tool is U.S. Pat. No. 7,246,402 (Washburn).

SUMMARY

There is provided a variable angle corner flusher tool which includes a pair of blades pivotally connected along one edge. The blades are relatively movable in a first direction to form an increasingly acute angle and movable in a second direction to form an increasingly obtuse angle. At least one spring exerts a biasing force to bias the blades in one of the first direction or the second direction. The embodiment which will hereinafter be described, the blades are biased in the second direction. An activator assembly is provided selectively resisting the biasing force of the at least one spring to facilitate angular adjustment of the blades. The activator assembly includes an activator screw and a slider bracket that moves axially along the activator screw. A pair of linkage arms are provided, with each linkage arm having a first end attached to the slider bracket and a second end attached to one of the pair of blades. The linkage arms result in an axial position of the slider bracket along the activator screw determining the angular positioning of the blades. A ratchet plate is pivotally mounted to the slider bracket. The ratchet plate is selectively pivoted between an engaged position engaged with the activator screw and a disengaged position disengaged from activator screw.

The activator assembly, as described above, permits angular adjustment in three ways. Firstly, with the ratchet plate in the engaged position, the activator screw is rotated to control the axial position of the slider bracket, with the linkage arms moving the blades in proportion to the movement of the slider bracket. Secondly, with the ratchet plate in the disengaged position, slider bracket is manually moved along activator screw to a desired axial position with the linkage arms moving the blades in proportion to the movement of the slider bracket. The ratchet plate is then returned to the engaged position to fix the slider bracket in position. Thirdly, with the ratchet plate in the engaged position, the variable angle corner flusher is pushed into a corner. The blades will pivot to conform to an angle of the corner with the ratchet plate fixing the slider plate in position.

BRIEF DESCRIPTION OF THE DRAWINGS

These and other features will become more apparent from the following description in which reference is made to the appended drawings, the drawings are for the purpose of illustration only and are not intended to be in any way limiting, wherein:

FIG. 1*b* is a top plan view of the variable angle corner flusher tool of FIG. 1*a*, with blades set at a second angle.

DETAILED DESCRIPTION

Figure 1A:
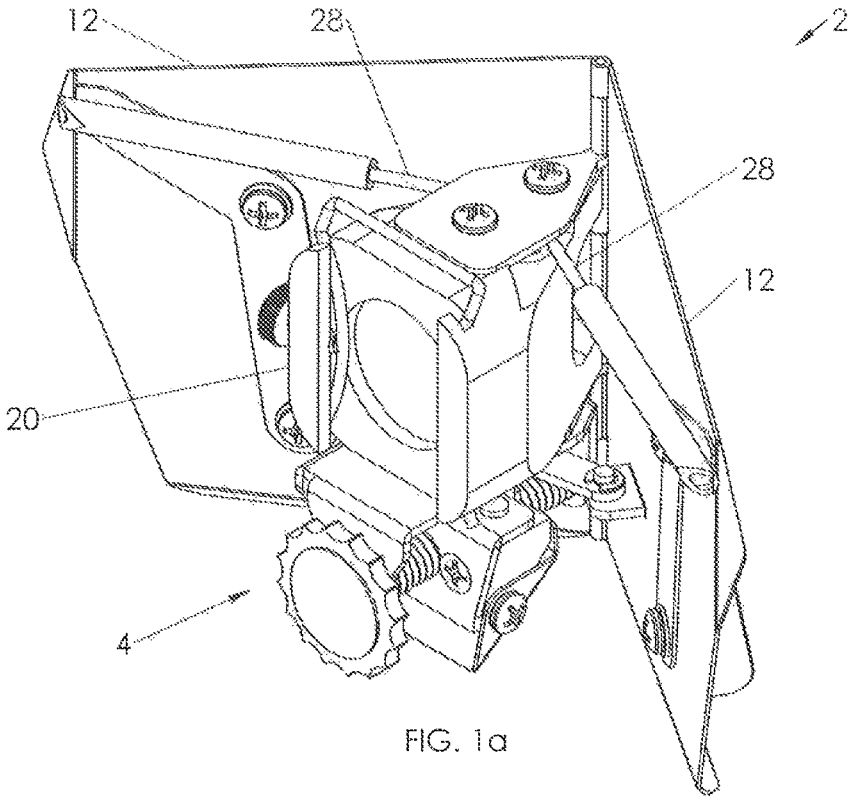
FIG. 1*a* is a top perspective view of a variable angle corner flusher tool.
Figure 1B:
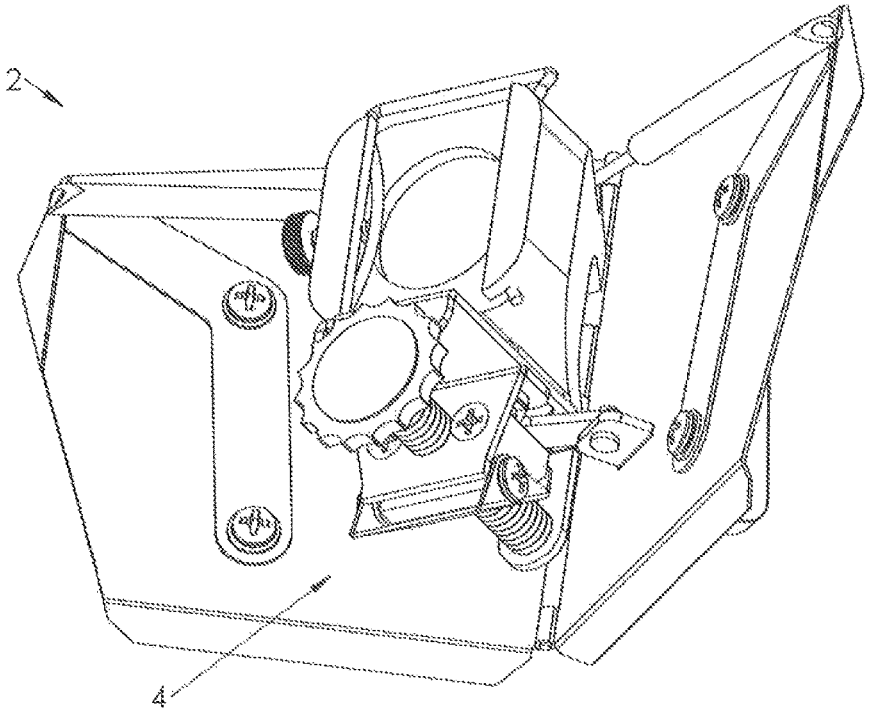
FIG. 1*b* is a bottom perspective view of the variable angle corner flusher tool of FIG. 1*a*.

A variable angle corner flusher tool, generally identified by reference numeral 2, will now be described with reference to FIG. 1*a* through 4*d*.

Figure 1C:
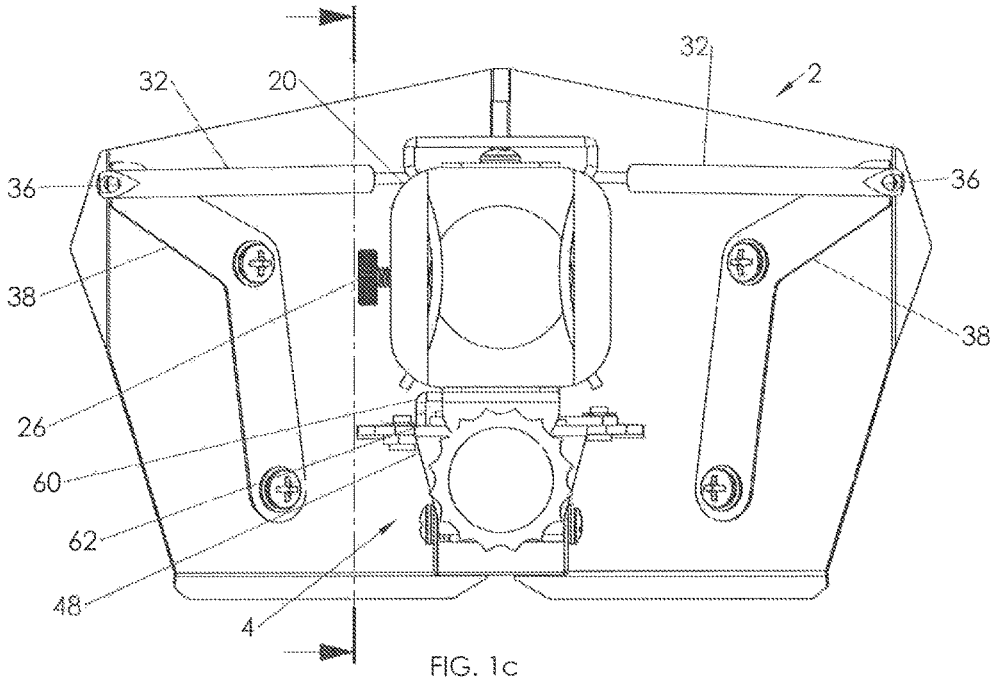
FIG. 1*c* is a rear elevation view of the variable angle corner flusher tool of FIG. 1*a*.
Figure 1D:
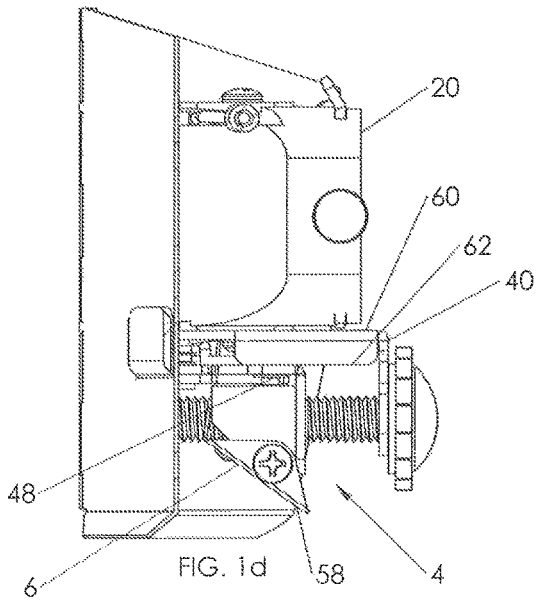
FIG. 1*d* is a side elevation view, in section, of the variable angle corner flusher tool, taken along section line of FIG. 1*c*.
Figure 1J:
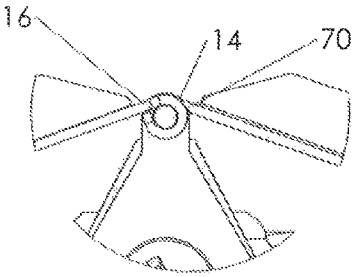
Figure 2:
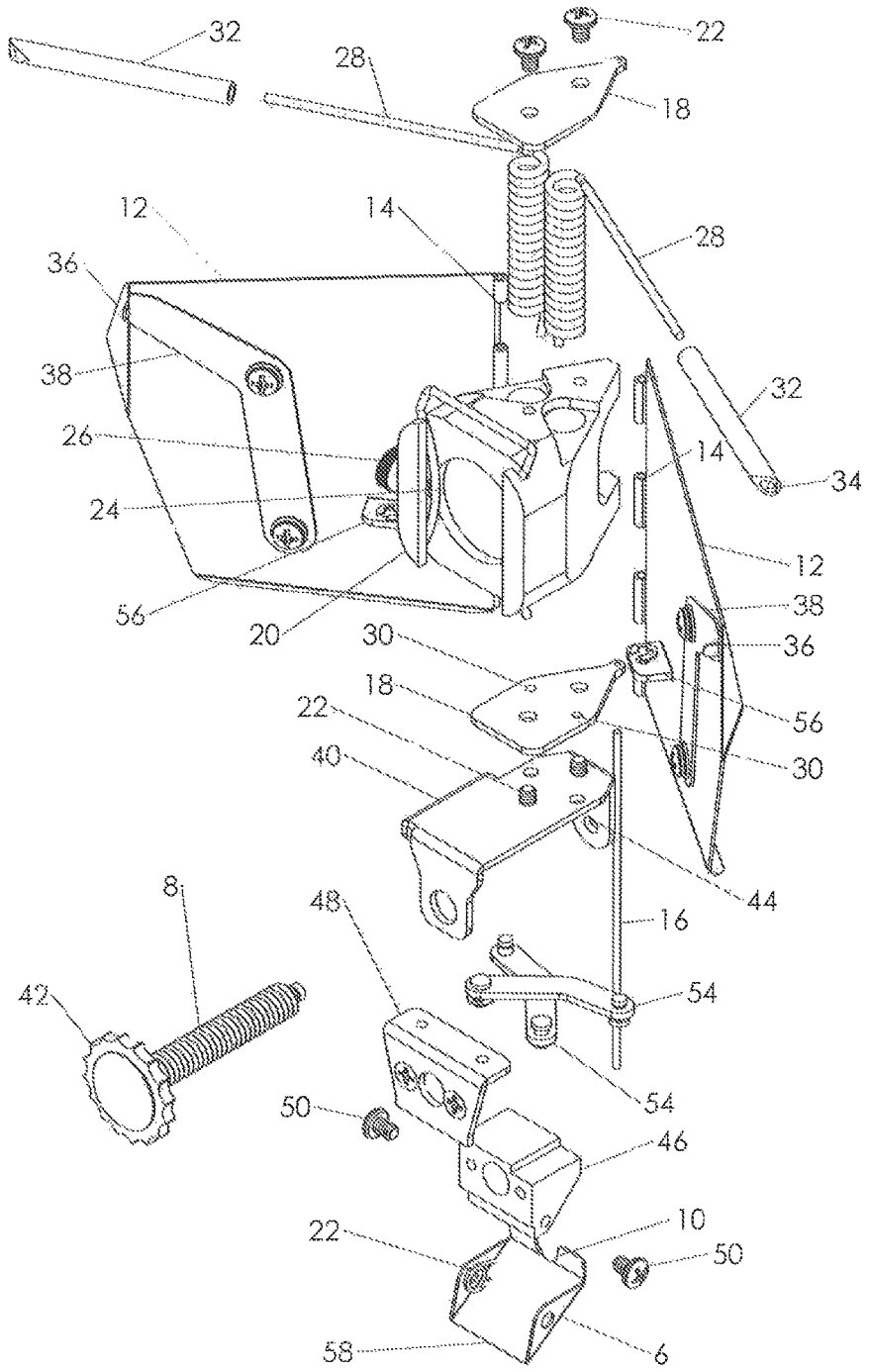
FIG. 2 is an exploded view of the variable angle corner flusher of FIG. 1*a*.

Structure and Relationship of Parts:

Referring to FIG. 1*a*, variable flusher 2 has hinged blades 12. Referring to FIG. 1*j*, the hinge is formed with knuckles 14 and pin 16. Referring to FIG. 2, two body plates 18 are held by hinge pin 16 and sandwiched between hinge knuckles 14. The hinge knuckles 14 and pin 16 have a tight tolerance and blade 12 has tight clearance with the opposing blade 12 to limit the flow of compound between these parts and leave a line of compound in the corner between drywall that will need to be sanded away after drying. Referring to FIG. 1*j*, blades 12 have angled edge 70 to further reduce the gap between blade and knuckle. Body 20 is secured to body plates 18 with threaded fasteners 22.

Referring to FIG. 2, body 20 has spring retainer 24 that holds the ball at the end of a handle (not shown). Thumb screw 26 on body 20 prevents spring retainer 24 from compressing and releasing the ball.

Referring to FIG. 2, torsion springs 28 are housed within body 20. Holes 30 in body plate restrict rotation of torsion springs 28. Tubes 32 act as sliding surfaces for the long end of torsion springs 28. Referring to FIG. 1*c*, each tube 32 has a transverse hole 34 at its distal end for bent tip 36 of retainer plate 38 to extend through and pin tube to blade 12. Torsion springs 28 bias blades 12 away from body 20.

Figure 4A:
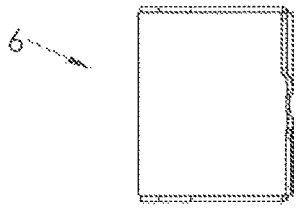
FIG. 4*a* is a top plan view of a ratchet plate.
Figure 4B:
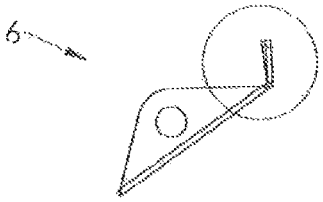
FIG. 4*b* is a side elevation view of the ratchet plate of FIG. 4*a*.
Figure 4C:
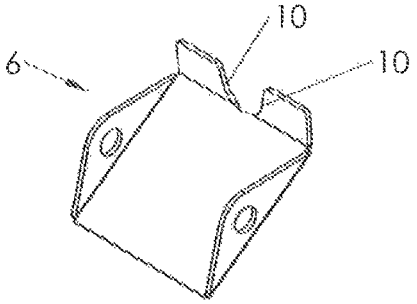
FIG. 4*c* is a top perspective view of the ratchet plate of FIG. 4*a*.
Figure 4D:
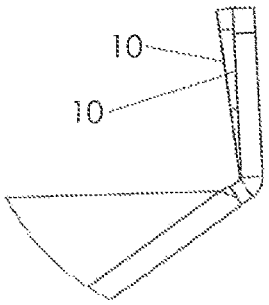
FIG. 4*d* is a detailed side elevation view showing ratchet plate partial thread detail from FIG. 4*b*.

Referring to FIG. 2, activator bracket 40 is fastened to body 20. Activator screw 8 with thumb adjustor knob 42 penetrates activator bracket 40 and is secured by external retaining ring 44. Slider block 46 and slider bracket 48 are fastened together and slide along activator screw 8. Ratchet plate 6 hinged with fasteners 50 to slider block 46 is torsion spring 52 biased for plate partial threads 10 to engage with threads of activator screw 8. Referring to FIG. 4*d*, ratchet plate partial threads 10 are bent at different angles and/or may be bent at different locations to enhance the engagement of the threads with those of activator screw 8. Referring to FIG. 2, linkage arms 54 are pined to slider bracket 48 and to blade tabs 56. Linkage arms 54 keep activator bracket 40 and body 20 positioned mid plane between blades 12.

Figure 3A:
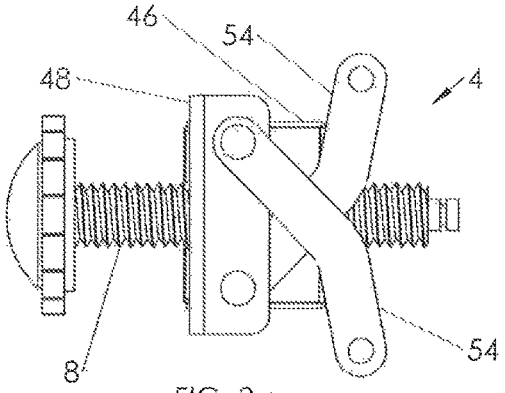
FIG. 3*a* is a detailed top plan view of an activator assembly.
Figure 3B:
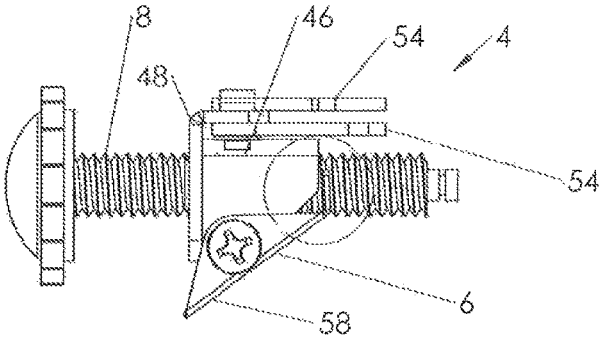
FIG. 3*b* is a detailed side elevation view of the activator assembly of FIG. 3*a*.
Figure 3C:
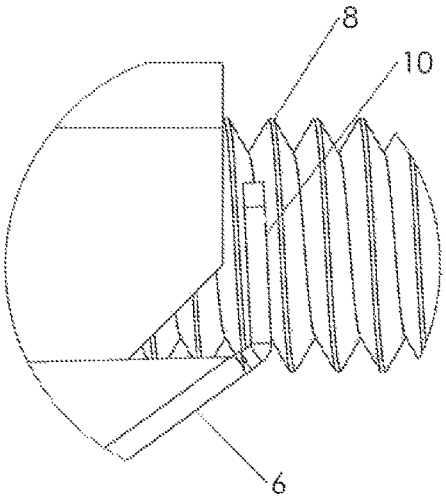
FIG. 3*c* is a detail sided elevation view showing ratchet plate and activator screw detail from FIG. 3*b*.

Referring to FIG. 3*a* and FIG. 3*b*, activator assembly 4 consists of linkage arms 54, slider bracket 48, slider block 46, activator screw 8, and ratchet plate 6. Activator assembly 4 resist the outward bias of torsion springs 28 and allows the angle between blades 12 to be adjusted. There are three ways to adjust the angle of blades 12. The first is to use thumb adjustor 42 on activator screw 8 to control the position of slider bracket 48 and linkage arms 54 via ratchet plate 6. The second is to disengage ratchet plate 6 from the activator screw by applying finger pressure to lever 58, position slider bracket 48 as desired, then release ratchet plate 6 to fix the position. The third way is to start with the flusher in a wide angle (as seen in FIG. 1*i*) then push the flusher body 20 into the corner between drywall sheets; ratchet plate 6 ratchets along activator screw 8 threads then engages when the angle between the sheets reached. Referring to FIG. 1*c*, activator bracket 40 has bend 60 whose edge 62 runs along slider bracket 48 to prevent rotation of activator assembly 4. Referring to FIG. 3*b*, lever 58 for ratchet plate 6 may have holes through it or knurling to increase traction when being depressed by a finger.

Figure 1E:
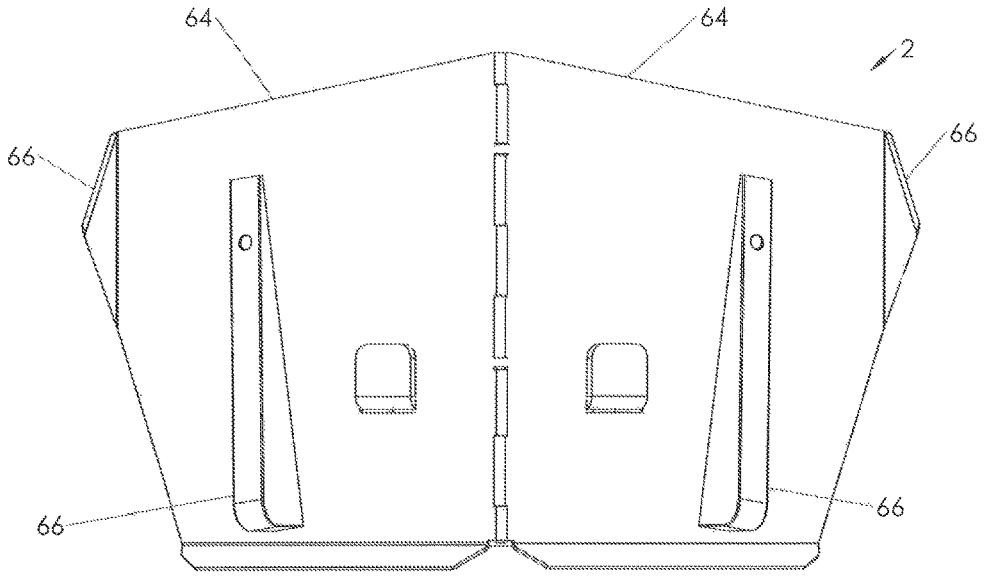
FIG. 1*e* is a front elevation view of the variable angle corner flusher tool of FIG. 1*a*.
Figure 1F:
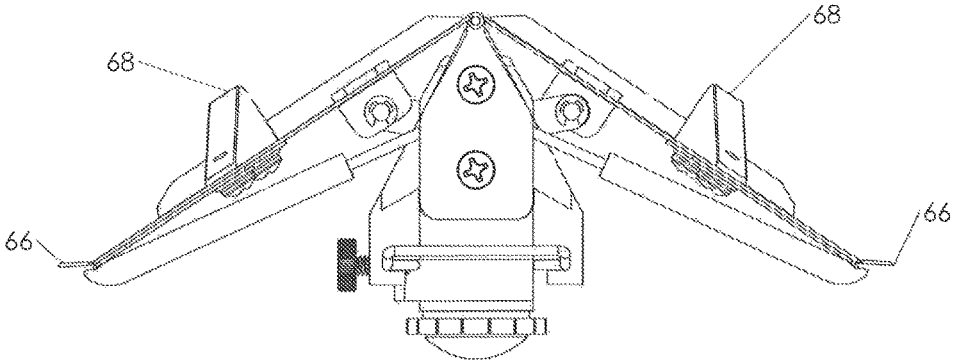
FIG. 1*f* is a top plan view of the variable angle corner flusher tool of FIG. 1*a*, with blades set at a first angle.
Figure 1G:
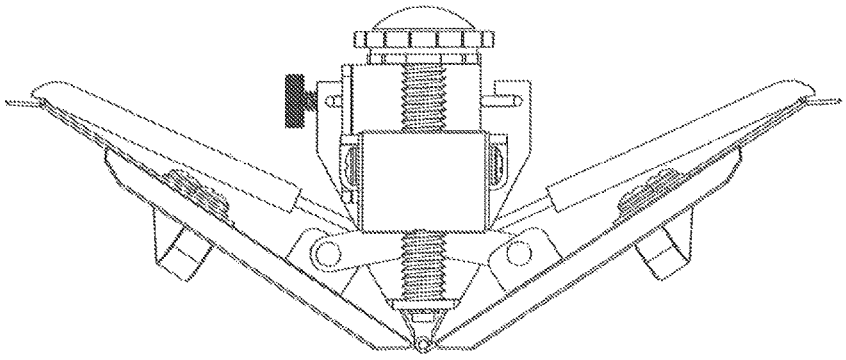
FIG. 1*g* is a bottom plan view of the variable angle corner flusher tool of FIG. 1*a*.
Figure 1H:
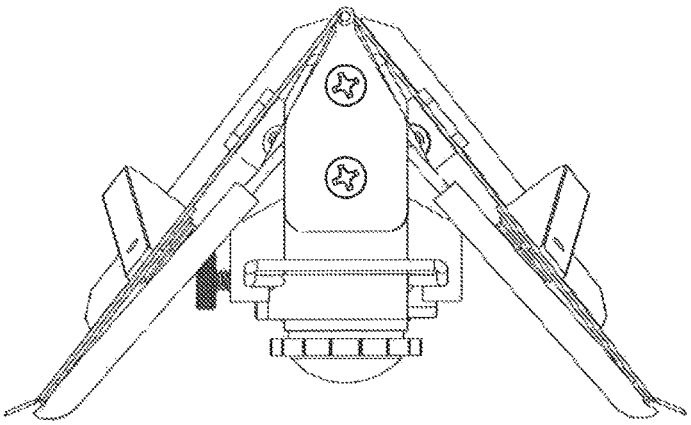
FIG. 1*i* is a top plan view of the variable angle corner flusher tool of FIG. 1*a*, with blades set at a third angle.
FIG. 1*j* is a detailed top plan view showing hinge detail taken from FIG. 1*i*
Figure 1I:
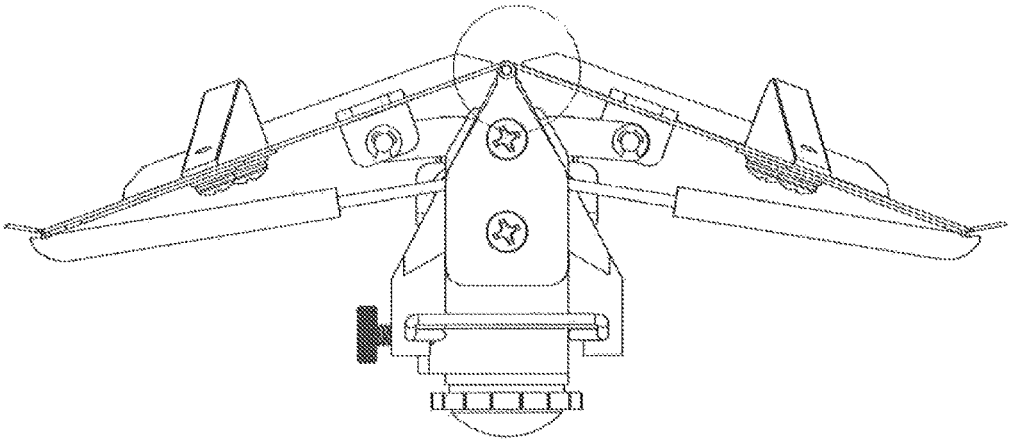

Referring to FIG. 1*e* and FIG. 1*f*, blades 12 have trailing edge 64 and feathering tabs 66 that apply a thin flat coat of compound to the joint between drywall sheets. Runners 66 run along the drywall at the leading portion of the flusher and keep the flusher at a specific orientation angle in relation to each sheet.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. A variable angle corner flusher tool comprising:

a body;

a pair of blades pivotally connected along one edge by a hinge pin that is supported by the body, the blades being relatively movable in a first direction to form an increasingly acute angle and movable in a second direction to form an increasingly obtuse angle;

at least one spring exerting a biasing force to bias the blades in one of the first direction or the second direction;

an actuator assembly selectively resisting the biasing force of the at least one spring to facilitate angular adjustment of the blades, the actuator assembly including:

an activator screw supported by the body, a slider bracket that freely slides axially along the activator screw;

a pair of linkage arms, each linkage arm having a first end attached to the slider bracket and a second end attached to one the pair of blades, such that an axial position of the slider bracket along the activator screw determines the angular positioning of the blades; and a ratchet plate pivotally mounted to the slider bracket, the ratchet plate has an engaged position engaged with the activator screw to lock the slider bracket in a selected axial position along the activator screw and a disengaged position disengaged from activator screw whereby the slider bracket is free to slide along the activator screw, the ratchet plate ratcheting along the activator screw when a force is exerted in a first axial direction and maintaining engagement with the activator screw when a force is exerted in a second axial direction, the activator screw having an adjustor knob, and turning of the activator screw by manipulation of the adjustor knob when the ratchet plate is in the engaged position moving the slider bracket with such movement of the slider bracket being transmitted through the pair of linkage arms to alter the angular positioning of the blades.

* * * * *